US005367276A

United States Patent [19]

Castonguay

[11] Patent Number: 5,367,276

[45] Date of Patent: Nov. 22, 1994

[54] METHOD CASE CIRCUIT BREAKER MOVABLE CONTACT ARM ARRANGEMENT

[75] Inventor: Roger N. Castonguay, Terryville, Conn.

[73] Assignee: General Electric, New York, N.Y.

[21] Appl. No.: 136,835

[22] Filed: Oct. 18, 1993

[51] Int. Cl.[5] ..... H01H 75/00

[52] U.S. Cl. ..... 335/16; 335/147; 335/195

[58] Field of Search ..... 335/35, 16, 147, 195; 200/147 R

[56] References Cited

U.S. PATENT DOCUMENTS

| | | | |
|---|---|---|---|
| 4,375,021 | 2/1983 | Pardini et al. . | |
| 4,583,065 | 4/1986 | Favre-Tissot . | |
| 4,733,033 | 3/1988 | Morris et al. . | |
| 4,733,211 | 3/1988 | Castonguay et al. . | |
| 4,736,174 | 4/1988 | Castonguay et al. . | |
| 4,757,294 | 7/1988 | Todaro et al. . | |
| 4,782,583 | 11/1988 | Castonguay et al. . | |
| 4,789,848 | 12/1988 | Castonguay et al. . | |
| 4,916,419 | 4/1990 | Winter | 335/16 |
| 4,931,603 | 6/1990 | Castonguay et al. . | |
| 4,999,464 | 3/1991 | Bellino et al. . | |
| 5,126,708 | 6/1992 | Palais et al. . | |
| 5,217,111 | 6/1993 | Castonguay et al. . | |

OTHER PUBLICATIONS

U.S. Ser. No. 07,764,287 filed Sep. 23, 1991 to Bellino et al.

*Primary Examiner*—Lincoln Donovan

[57] ABSTRACT

A molded case circuit breaker movable contact arm electrically connects with the circuit breaker load terminal requiring only a small diameter auxiliary electrical braid conductor by pivotally arranging the contact arm within its support. The braid conductor is electrically connected with the movable contact arm and is contained within the contact arm support posts. The contact spring and the terminal screw retainer are formed from a single plate of spring steel. The contact arm support posts are capable of supporting movable contact arms of various thickness.

1 Claim, 5 Drawing Sheets

METHOD CASE CIRCUIT BREAKER MOVABLE CONTACT ARM ARRANGEMENT

BACKGROUND OF THE INVENTION

When utilizing high speed current limiting circuit interruption to interrupt the circuit current in the early stages of the current waveform, it is important that the movable contact arm size to be as small as possible to promote electrodynamic repulsion. A further approach to improving the dynamics of contact arm repulsion is to eliminate the heavy flexible braid conductor that connects the contact arm to the load terminal.

U.S. Pat. No. 4,931,603 entitled "Molded Case Circuit Breaker Movable Contact Arm Arrangement" describes a "braidless" connection between the movable contact arm and its support which does not require any flexible braid conductor and which is of a small size to promote electrodynamic repulsion. This Patent should be reviewed for its detailed description of the movable contact arm support.

When current limiting circuit interrupters are used within higher ampere-rated circuits, a small auxiliary flexible braid conductor is used to provide a parallel current path to deter pitting and such other corrosive electrical effects from occurring at the contact arm-contact support interface.

A further example of a braidless movable contact arm is found in U.S. Pat. No. 4,733,033. This Patent discloses the use of a spring having a planar configuration capable of holding the contact arm against its support posts with sufficient force to maintain electrical contact during overcurrent conditions. However, when this design is used within higher ampere-rated current limiting industrial circuit breakers, a parallel current path should be connected between the movable contact arm and the contact arm support posts to prevent the occurrence of arcing between the contact arm and the support posts under intense short-circuit overcurrent conditions.

The use of a smaller, lighter, flexible braid conductor to reduce the dynamic drag at the end of the movable contact arm, as described within U.S. Pat. No. 4,999,464, could cause wear on the end of the smaller, flexible braid under accelerated test conditions. This is believably due to the friction that occurs between the internal circuit breaker components and the end of the flexible braid that is directly welded or brazed to the end of the movable contact arm.

U.S. Pat. No. 4,583,065 entitled "Electric Connection of Braids on a Circuit Breaker Terminal" describes an arrangement for attaching the opposite end of the braid conductor to the circuit breaker terminal supports.

U.S. patent application Ser. No. 07/764,287 filed Sep. 23, 1991 entitled "Molded Case Circuit Breaker Movable Contact Arm Arrangement" describes the use of an off-set welding tab at the point of contact between the braid conductor and the movable contact arm to eliminate the fraying of the braid conductor that could occur under extreme test conditions.

U.S. Pat. No. 5,217,111 describes a screw retainer used with the movable contact arm assembly to retain the load terminal screw within the assembly. When movable contact arms of increased thickness are used within higher ampere-rated circuit breakers, a corresponding larger contact arm support assembly is required to accommodate the increased thickness.

It would be economically advantageous to provide a single contact arm support assembly to accommodate movable contact arms of differing thickness and to eliminate the requirement for the separate terminal screw retainer.

Further economic advantage could be attained by eliminating the off-set tab and the extra welding operations that the tab requires.

One purpose of the invention is to describe a movable contact arm support assembly capable of accepting movable contact arms of differing thickness as well as incorporating a screw retainer within the contact support structure. An additional purpose of the invention is to eliminate the off-set welding tab.

SUMMARY OF THE INVENTION

A molded case circuit breaker movable contact arm is mechanically and electrically connected to a terminal support by means of a pair of support posts. The terminal support includes a combined contact arm spring and terminal screw retainer assembly. A single pair of support posts accommodates movable contact arms of varying thickness by an off-set punching operation that shapes the movable contact arms of lower ampere rating to the support post dimensions. Trapping the braid conductor between the support posts eliminates the requirement of the off-set welding tab to prevent fraying of the braid conductor.

DESCRIPTION OF THE PREFERRED EMBODIMENT

Figure 1:
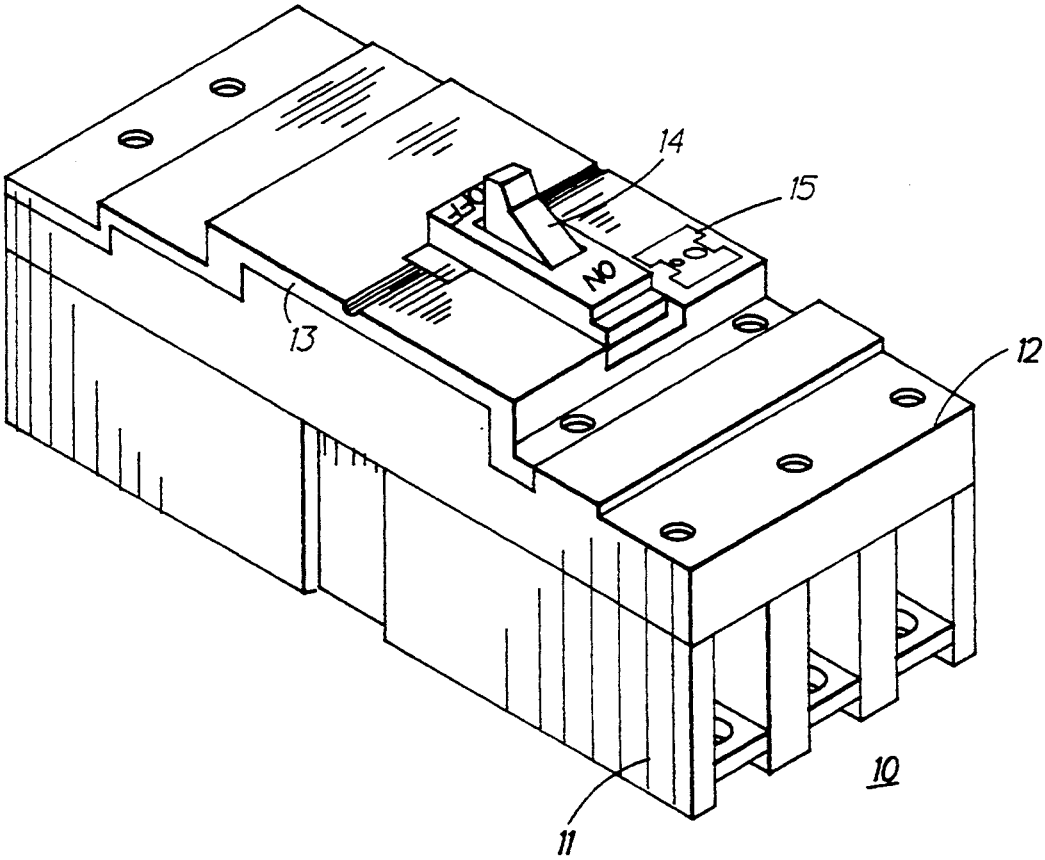
FIG. 1 is a top perspective view of a molded case circuit breaker including the contact arm arrangement in accordance with the invention.
Figure 2:
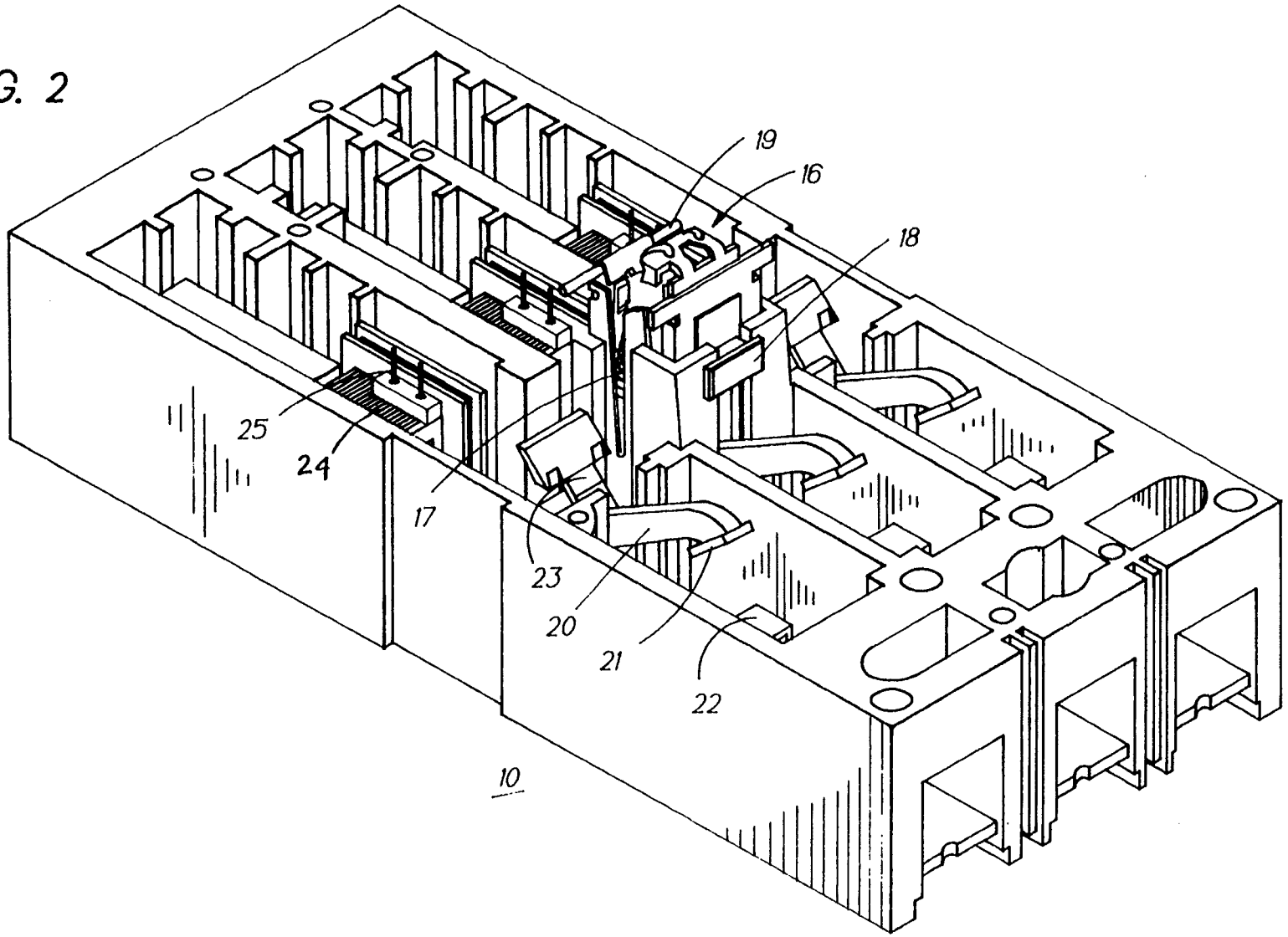
FIG. 2 is a top perspective view of the molded case circuit breaker of FIG. 1 with the cover removed to depict the circuit breaker operating mechanism arrangement and associated contact arms.

A current limiting circuit breaker 10 is depicted in FIG. 1 and consists of a case 11 to which a cover 12 is attached and which further includes an accessory cover 13. A circuit breaker operating handle 14 extends through a slot formed within the circuit breaker cover for manual intervention to turn the circuit breaker to its ON and OFF conditions. The rating plug 15 allows a single circuit breaker design to be used over a wide range of ampere ratings. As described in U.S. Pat. No. 4,757,294, an actuator unit (not shown) interfaces with an operating mechanism 16 by means of a trip bar 19 to separate the circuit breaker fixed and movable contacts 22, 21, best seen by referring now to FIG. 2. The operating mechanism acts upon the movable contact arm 20 to drive the movable contact arm to the open position, shown in the circuit breaker 10 depicted in FIG. 2, upon the occurrence of overcurrent conditions of a predetermined magnitude. The circuit current is sensed by means of current transformers, as indicated at 24, which connect with the circuit breaker trip unit by means of upstanding pins as indicated at 25. A unitary crossbar arrangement 23, such as described in U.S. Pat. Nos. 4,733,211 and 4,782,583, insures that the movable contact arms operate in unison when the operating mechanism is articulated. The operating mechanism is held against the bias of a pair of powerful operating springs 17 by means of a latch assembly 18, such as described in U.S. Pat. Nos. 4,736,174 and 4,789,848. In order to provide the current limiting functions described earlier, the movable contact arms are adapted for independent movement from the crossbar assembly by electrodynamic repulsion acting on the movable contact arm itself. One such example of a current limiting circuit breaker is found within U.S. Pat. No. 4,375,021.

Figure 3:
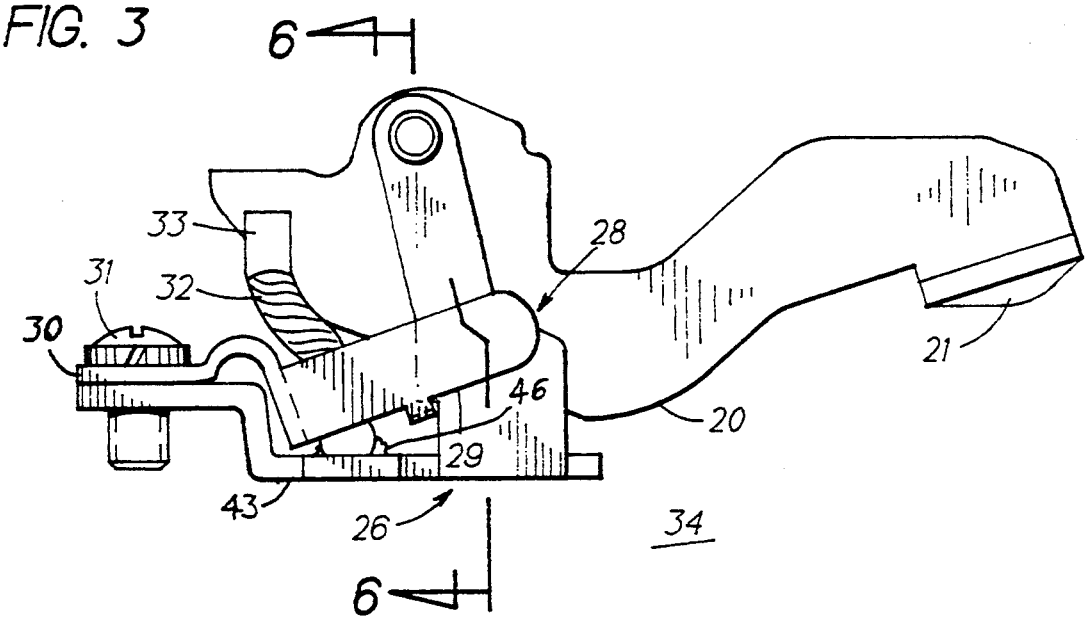
FIG. 3 is an enlarged side view of the movable contact arm support assembly within the circuit breaker of FIG. 2.

When such intense overcurrent conditions occur, it is important that the movable contact arms maintain good electrical contact with the contact arm supports while the movable contacts move away from the fixed contacts. The movable contact assembly 34 shown in FIG. 3 improves over that described within aforementioned U.S. patent application Ser. No. 07/764,287. The movable contact arm 20 with the movable contact 21 attached to one end is pivotally supported upon a contact arm support 26. The movable contact arm electrically connects with the circuit breaker current carrying components by means of a flexible braid conductor 32 which is welded to the end of the contact arm opposite the contact end, as indicated at 33. The opposite end of the braid is welded to the platform 43 at the bottom of the contact arm support as indicated at 46. Included on the contact arm support is a combined spring-retainer assembly 28 consisting of the spring 29 used to force the contact arm support into good electric contact with the contact arm, and the screw retainer 30 which retains the terminal screw 31.

Figure 4:
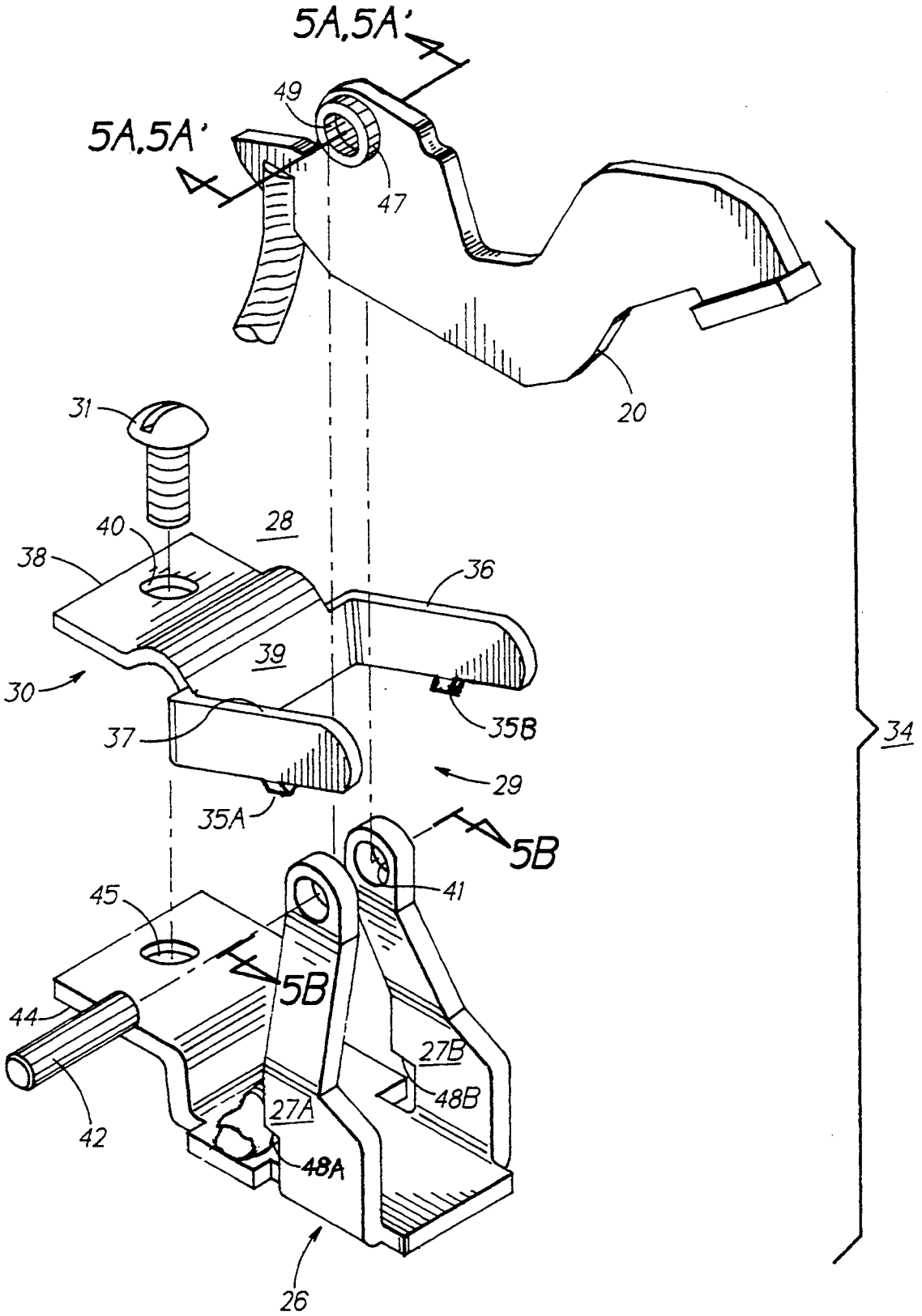
FIG. 4 is an enlarged top perspective view of the movable contact arm support assembly of FIG. 3 depicted in isometric projection.

The spring-retainer assembly 28 as shown in FIG. 4, is formed from a single plate of spring steel and is shaped to form the spring 29, which includes a pair of opposing sidearms 36,37 both of which include downwardly depending positioning tabs 35A,35B. When the assembly is positioned on the contact arm support 26, the tabs 35A,35B engage the undersides of the corresponding slots 48A,48B formed in the upstanding posts 27A,27B which automatically positions the screw retainer 30 on the stepped end 44 of the contact arm support. The screw retainer 30 includes a planar tab 38 joined to the spring 29 by means of the bight 39. The aperture 40 through the planar tab then automatically aligns with a corresponding aperture 45 formed in the stepped end 44. When the terminal screw 31 is later threadingly inserted through the apertures 40,45, the spring steel material tightly engages the terminal screw to prevent inadvertent removal.

The movable contact arm 20 differs from that described within the aforementioned U.S. patents by the provision of a raised perimeter 47 concentric to the aperture 49 which perimeter will be discussed below in greater detail. The movable contact arm is positioned intermediate the posts 27A,27B and the aperture 49 in the contact arm is aligned between the apertures 41 in the support posts. The pivot pin 42 is inserted within the apertures to pivotally retain the movable contact arm within the contact arm support. The clearance provided between the thru-holes 41 within the support arms and the ends of the pivot pin allows the movable contact arm to freely rotate within the support arms while maintaining good mechanical and electrical connection with the movable contact arm. The contact spring 29 maintains good electrical contact with the movable contact arm while the contact arm rotates between its closed and open position in order to deter local ionization and pitting between the contact arm and the pivot pin.

Figure 6:
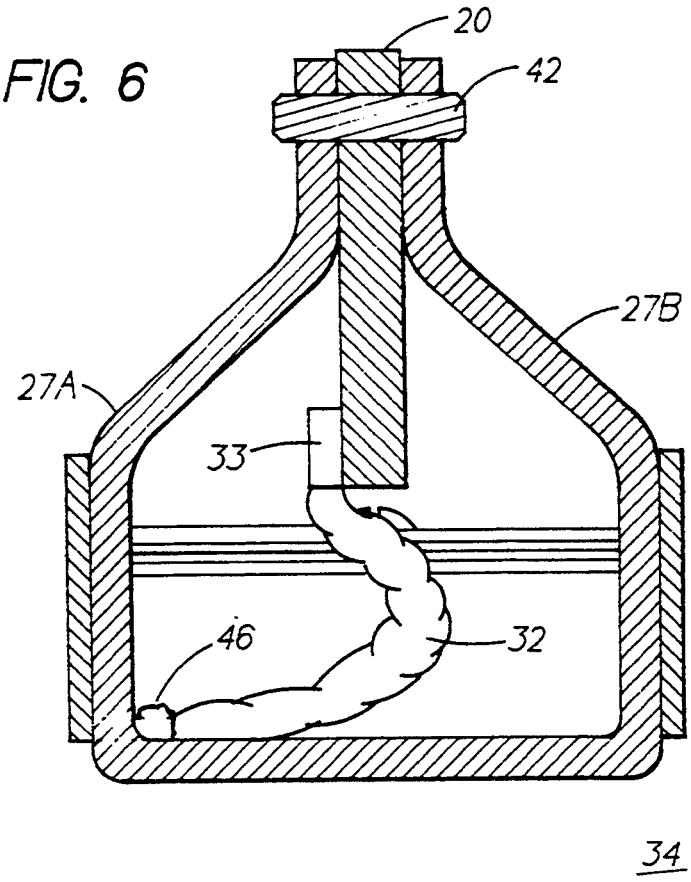
FIG. 6 is an enlarged front sectional view of the movable contact arm assembly of FIG. 6.
Figure 5:
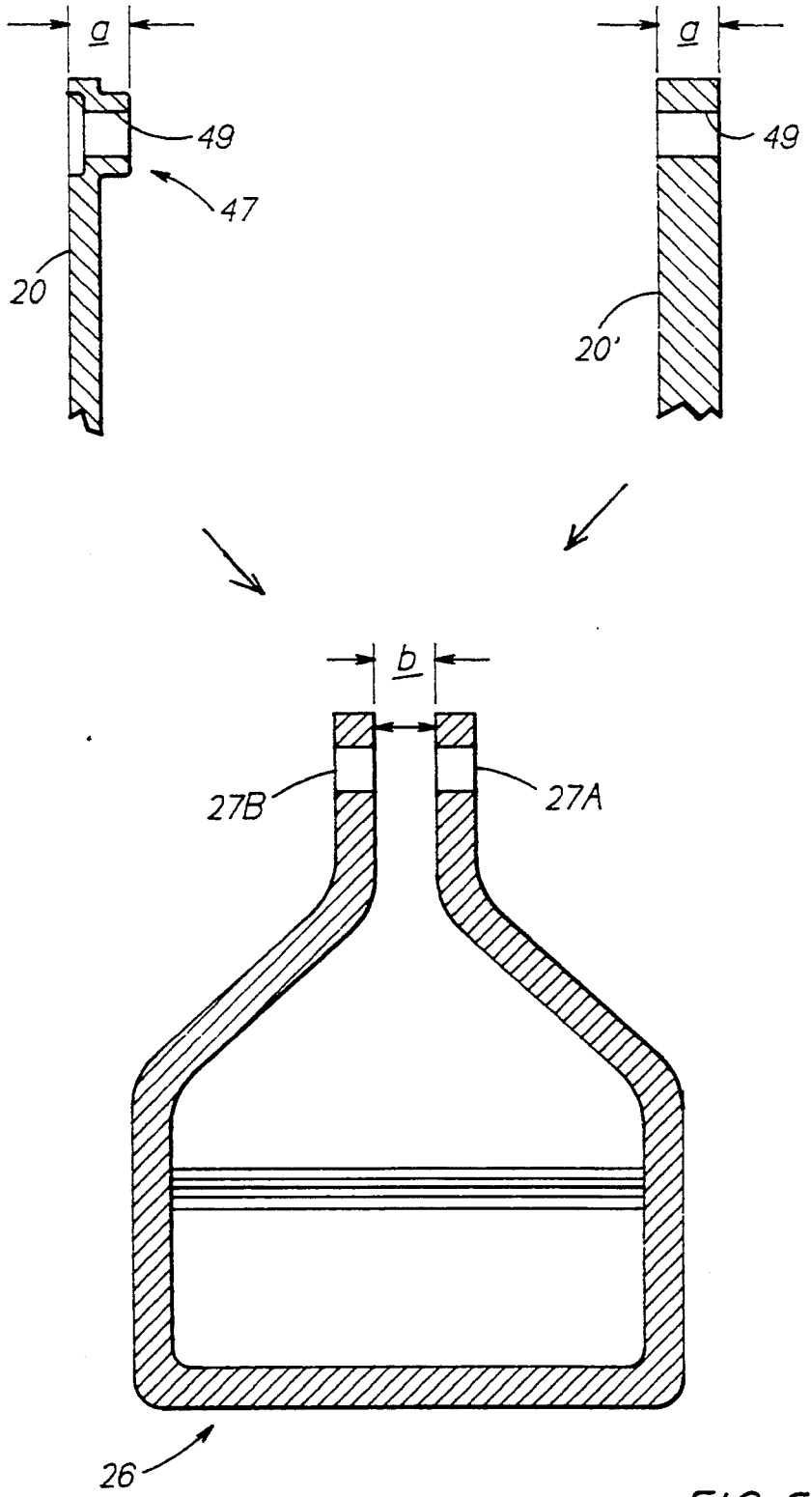
FIG. 5 is a front view in partial section of the movable contact arms and support assembly of FIG. 4.

To allow the contact arm support 26 to be used with contact arms of different thickness, the contact arm 20 is shown FIG. 5 with the raised perimeter 47 punch-formed around the aperture 49. The thickness of the movable contact arm in the vicinity of the perimeter as defined by the arrows A is the same as the thickness defined by the arrows B between the support posts 27A,27B on the contact arm support 26. The movable contact arm 20' has a thickness defined by the arrows A' which thickness is the same as that shown at A although the thickness of the contact arm 20' is greater than the thickness of the contact arm 20. To prevent the braid 32 from becoming frayed upon repeated rotation of the movable contact arm 20 about the pivot pin 42, the braid is completely captured between the posts 27A,27B as shown in FIG. 6. The contact arm assembly 34 is arranged such that the weld 33 at one end of the braid and the weld 46 at the opposite end are arranged to completely confine the braid inboard the contact arm assembly and thereby deter the braid from rubbing against the other circuit breaker components.

A movable contact arm assembly has been described that multi-functionally combines the function and structure of the terminal screw retainer and the contact spring. The capture of the braid has been found to eliminate fraying with no added cost or components. A single movable contact arm assembly supporting movable contact arms of different thickness eliminates the requirement of a separate contact arm assembly for each and every circuit breaker rating.

I claim:

1. A movable contact arm support assembly for molded case circuit breakers comprising:

a metal support base having one end of a conductor braid attached thereto;

a pair of support posts upstanding from said support base defining a predetermined separation distance at one end;

a movable contact arm having a movable contact attached to a first end and an opposite end of said conductor braid attached to a second end, said contact arm being pivotally-supported intermediate said support posts, said conductor braid being arranged completely within said support posts and said support posts being electrically connected to said support base, said movable contact arm comprising a thickness less than said predetermined separation distance, said contact arm further including an aperture intermediate said first and second ends;

a screw retainer-contact spring having a pair of arms extending from one end and an apertured tab extending from an opposite end, said pair of arms encompassing said support posts to hold said support posts to promote electrical transport between said support base and said contact arms, said apertured tab being arranged to receive and retain a terminal screw; and a raised perimeter about said aperture, said raised perimeter providing a dimension equivalent to said separation distance.

* * * * *